US005409210A

United States Patent [19]

Linder et al.

[11] Patent Number: 5,409,210

[45] Date of Patent: Apr. 25, 1995

[54] ARRANGEMENT FOR STEP-BY-STEP CONVEYANCE OF PRINTED PRODUCTS

[75] Inventors: Heinz Linder, Zofingen; Albert Eugster, Strengelbach, both of Switzerland

[73] Assignee: GRAPHA-Holding AG, Hergiswil, Switzerland

[21] Appl. No.: 113,169

[22] Filed: Aug. 27, 1993

[30] Foreign Application Priority Data

Sep. 2, 1992 [CH] Switzerland ..... 02752/92

[51] Int. Cl.[6] ..... B65H 5/08

[52] U.S. Cl. ..... 271/277; 271/204; 271/82

[58] Field of Search ..... 271/82, 85, 204, 206, 271/277

[56] References Cited

U.S. PATENT DOCUMENTS 4,475,459 10/1984 Wanke et al. ..... 271/82 X
4,732,374 3/1988 Honegger ..... 271/277 X
5,110,108 5/1992 Muller ..... 271/82 X

FOREIGN PATENT DOCUMENTS 0305671 3/1989 European Pat. Off. .
0499691 8/1992 European Pat. Off. .

*Primary Examiner*—H. Grant Skaggs
*Assistant Examiner*—Carol Lynn Druzbick
*Attorney, Agent, or Firm*—Friedrich Kueffner

[57] ABSTRACT

An arrangement for the step-by-step conveyance of printed products, such as, newspapers, magazines or the like from a removal location, wherein the printed products are supplied to the removal location by a conveying unit approximately vertically and spaced apart from each other. The arrangement includes at least one set of gripping tongs for gripping the lower ends of the printed products at the removal location. The gripping tongs are connected to a driven hub. The gripping tongs are retractably controlled by the periphery of the hub which interacts with a friction wheel arranged after the removal location. The gripping tongs extend through a space which is arranged downstream and is provided for the controlled release of the printed products. The space is defined by conveying members which are driven in the same direction.

14 Claims, 1 Drawing Sheet

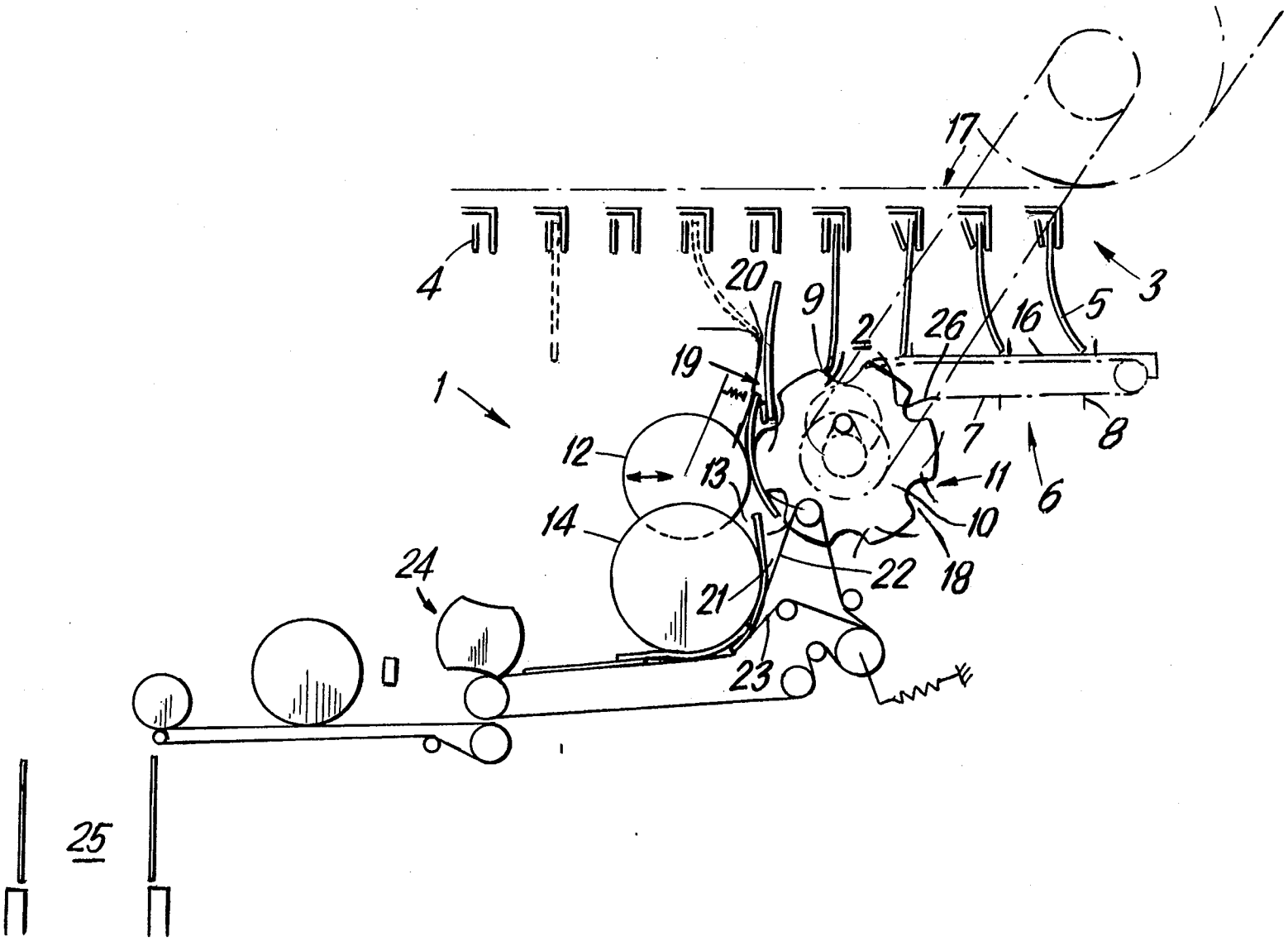
1
2
3
4
5
6
7
8
9
10
11
12
13
14
16
17
18
19
20
21
22
23
24
25
26

ARRANGEMENT FOR STEP-BY-STEP CONVEYANCE OF PRINTED PRODUCTS

BACKGROUND OF THE INVENTION

1. Field of the Invention

The present invention relates to an arrangement the step-by-step or cyclical conveyance from a removal location of printed products, such as, newspapers, magazines or the like, which are supplied to the removal location by means of a conveying unit approximately vertically and spaced apart from each other.

2. Description of the Related Art

The feeding or supplying units described above are used, for example, for feeding printed products to stacking devices and make it possible by selective separation to pick-up or transfer the total quantity or a partial quantity of the printed products at the removal location. These devices have the disadvantage that the transfer of the printed products at the removal location between transporting unit and further conveying unit does not take place without interruptions, particularly since the printed sheets are transferred at a relatively high speed from one conveying unit to the next following conveying unit.

SUMMARY OF THE INVENTION

Therefore, it is the primary object of the present invention to construct an arrangement of the above-described type in such a way that the conveying units of the arrangement ensure a precise and reliable interaction between the units.

In accordance with the present invention, at least one set of gripping tongs are provided for the removal location. The gripping tongs are connected to a driven hub. The gripping tongs are retractably controlled by the periphery of the hub which interacts with a friction wheel arranged after the removal location. The gripping tongs extend through a space which is arranged downstream and is determined for the controlled release of the printed products. The space is defined by conveying means which are driven in the same direction.

The structural features of the present invention make it possible in a simple manner to feed the printed products in a continuous flow from the conveying device, for example, a transporting unit, to a subsequent processing station.

The printed products are guided essentially without slippage along their path from the removal location until they leave the arrangement.

During the circulating movement of the gripping tongs, the gripping tongs are placed in a positively controlled manner into an open position which occurs at the latest at the removal location and, after the printed product has been inserted or introduced into the gripping tongs, the gripping tongs are suddenly closed. The gripping tongs pivot back with the gripped end of the printed product into a recess on the periphery of the hub and remain in the recess until the gripping tongs have left the friction point between hub and friction wheel and extend into the space determined for the release of the printed product in which the gripping tongs are opened in a positively controlled manner. During opening of the gripping tongs, the previously gripped end of the printed product is released and, as necessary, is moved subsequently by the trailing part of the tongs in the direction of the further transport.

Toward the end directed downstream, the space intended for releasing the printed products is defined by unidirectionally driven conveying means, for example, a deflection roller and endless drive belts moving on the deflection roller.

In accordance with an advantageous feature of the invention, a secure feeding of the printed products is ensured by arranging the conveying unit in the area of the removal location so as to extend approximately parallel to the tangent to the circumference of the hub.

In accordance with a useful feature of the invention, a driving unit for aligning the printed sheets into the position of their removal is arranged underneath the conveying unit. This driving unit ensures that feeding can be carried out uniformly and, thus, with the required reliability.

In order to achieve a uniform step-by-step transfer, a drive connection is provided between the driving unit and the hub.

The conveying unit and the hub are also connected so as to obtain a synchronous step-by-step operation.

For the selective removal of printed products, the conveying unit includes a guide track which above the removal location includes a portion which is displaceable upwardly, so that, in accordance with a further development of the present invention, the supplied printed products can be removed in a selectable formation.

In order to achieve an optimum conveying action between the hub and the friction wheel, the gripping tongs are advantageously constructed so as to be lowerable into recesses arranged at the periphery of the hub, wherein a positively controlled moving mechanism can be provided for this purpose, such as, a toothed drive, a cam drive or a lever drive.

In accordance with another advantageous feature, the trailing portion of the tongs is constructed so as to deflect away the printed product which is separated from the gripping tongs in the space defined by the unidirectionally driven conveying means. As a result, the printed product can be grasped at the end of this space for the further transport thereof.

In accordance with another useful feature, the distance between the hub and the friction wheel is adjustable. Consequently, the conveyance of the printed sheets is optimized because the distance is adjustable to take into consideration the different thicknesses of the printed products.

The feature of the adjustable distance can be further optimized by means of a spring whose force acts on the friction wheel.

The conveying action can be further improved by providing a rubber lining or a similar lining on the circumference of the friction wheel.

By providing a deflection roller and at least one endless drive belt driven together with the deflection roller, the space formed by the conveying means can be provided with a conveying effect by forming an inlet gap in the downstream direction.

In addition, the space defined by the conveying means is formed exclusively by unidirectionally driven elements.

As an additional means for guiding the printed products in the area of the connection between the deflection roller and drive belt or drive belts, an endless guide belt resting against the deflection roller or drive belt can be used.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

BRIEF DESCRIPTION OF THE DRAWING

In the drawing:

The single figure of the drawing is a schematic illustration of an embodiment of the arrangement according to the present invention.

DESCRIPTION OF THE PREFERRED EMBODIMENT

The drawing shows an arrangement 1 for the step-by-step or cyclical conveyance of printed products 5, such as, newspapers, magazines or the like, from a removal location. The printed products 5 are supplied by means of a conveying unit 3, for example, a conveyor equipped with holding clamps 4. The supplied printed products 5 are usually folded and clamped with the open side thereof in the holding clamp 4.

As the printed products 5 travel to the removal location 2, and before being removed from the holding clamps 4 which are moved approximately parallel to a horizontal tangent to the circumference of a hub 10, the printed products are guided over a stabilizing unit 6 in which the position of the printed products 5 is stabilized or steadied.

This procedure can be carried out by means of driving elements 8 which are fastened to an endless pulling member 7. The drive elements 8 are placed in contact with the rear sides of the printed products 5 on a guide rail 16 which is inclined toward the removal location. As a result, the driving elements 8 have a stabilizing effect on the printed products 5.

For this purpose, the drive elements 8 have a greater spacing therebetween and a higher travel speed than the supplied printed products.

Of course, hub 10 and conveying unit 3 are coupled to each other so as to operate with the same cycle.

At the guide track of the conveying unit 3 indicated with dash-dot lines 17, it is possible to carry out above the removal location 2 a selective separation or partial removal of the supplied printed products 5.

In the closed state, i.e., after gripping a printed product 5, the gripping tongs 11 are controlled inwardly and rearwardly offset from the circumference of the hub 10, so that hub 10 and guide roller 14 can roll uniformly without damaging the printed products 5.

For this purpose, the gripping tongs 11 are constructed so as to be swingable and can be lowered into recesses 18. As a result, gripping of the printed products 5, for example, at the folded edge 9 is favorably influenced, wherein at least one set of gripping tongs 11 connected to the driven hub 10 is provided. These gripping tongs 11 are controlled so as to be placeable behind the circumference of the hub 10 after the printed products 5 have been gripped, so that, together with a friction wheel 12 arranged subsequently to the removal location, the hub 10 can produce a conveying effect on the printed products 5. Subsequently, the printed products 5 travel approximately in vertical direction through a free space 13 which is formed by several drive elements, wherein an area of opening of the space 13 is defined by the hub 10 as well as the friction wheel 12 and an inlet gap at the conveying end of the space 13 is defined by a deflection roller 14 and an endless drive belt 22 which partially surrounds the deflection roller 14.

The use and configuration of gripping tongs for the removal and conveyance of printed products are well known, so that a detailed description thereof is unnecessary.

Because of the different thicknesses of the printed products and for producing a friction pressure, the distance between the hub 10 and the friction wheel 12 is constructed so as to be adjustable.

The friction wheel can be resiliently pressed against the hub 10 by means of an energy storing device, not shown.

The trailing part 26 of the set of gripping tongs 11 at the circumference of the hub 10 has the additional purpose of deflecting into the conveying direction the front edge of the printed product 5 which has just been discharged.

The hub 10 and the friction wheel 12 form an inlet gap 19 which is open toward the removal location 2 and which forms a guide device with a guide surface 20 which is spaced from the circumference of the hub 10.

The end of the space 13 which is directed downstream has an inlet gap 21 which is formed by the deflection roller 14 and at least one drive belt 22 which partially surrounds the deflection roller 14.

If two drive belts 22 which are guided in parallel are used, as illustrated in the drawing, it is possible to provide therebetween a contacting guide belt 23 in the deflection area at the deflection roller 14.

The printed products 5 leave the deflection area at the deflection roller 14 in a scale-like configuration and can be re-arranged after or before the deflection roller 14 by means of a device 24 for removing the scale-like configuration.

Of course, a decollating formation of the printed products 5 is also possible, wherein decollation can be carried out at the removal location 2 as well as after the deflection roller 14.

In the illustrated embodiment, the deflection roller 14 is followed by a stacker 25 which is provided for receiving the printed products 5.

The invention is not limited by the embodiments described above which are presented as examples only but can be modified in various ways within the scope of protection defined by the appended patent claims.

We claim:

1. An arrangement for step-by-step conveyance of printed products, such as, newspapers, magazines or the like, from a removal location, the arrangement comprising a conveying unit for supplying the printed products to the removal location approximately vertically and spaced apart from each other, at least one set of gripping tongs for the removal location, the gripping tongs being connected to a driven hub, the gripping tongs being retractably controlled by a periphery of the hub, a friction wheel arranged after the removal location for interacting with the hub periphery, the gripping tongs extending through a space arranged downstream for releasing the printed products in a controlled manner, the space being defined by conveying means, and means for driving the conveying means in the same direction.

2. The arrangement according to claim 1, wherein the conveying unit extends approximately parallel to a tangent to the hub periphery.

3. The arrangement according to claim 2, further comprising a stabilizing unit mounted underneath the conveying unit for aligning the printed products into a removal position.

4. The arrangement according to claim 3, wherein the stabilizing unit is inclined toward the removal location.

5. The arrangement according to claim 3, comprising a drive connection for connecting the stabilizing unit with the hub.

6. The arrangement according to claim 3, wherein the stabilizing unit comprises an endless pulling member and drive elements mounted on the pulling member for resting against and traveling with ends of the printed products.

7. The arrangement according to claim 6, wherein the drive elements are spaced apart from each other by a greater distance than the supplied printed products and the drive elements have a greater travel speed than the printed products.

8. The arrangement according to claim 1, comprising drive means connecting the hub and the conveying unit.

9. The arrangement according to claim 1, wherein the periphery of the hub has recesses, the gripping tongs having a closed position, wherein the gripping tongs in the closed position are lowerable into the recesses of the hub periphery.

10. The arrangement according to claim 1, wherein the gripping tongs have a trailing portion, the trailing portion of the gripping tongs being a deflecting device.

11. The arrangement according to claim 1, comprising means for adjusting the distance between the hub and the friction wheel.

12. The arrangement according to claim 1, wherein the hub and the friction wheel define an inlet gap following the removal location, the inlet gap comprising a guide surface spaced from the hub periphery.

13. The arrangement according to claim 1, wherein the space has an end which is directed downstream, further comprising a deflection roller forming the downstream end of the space, and at least one endless drive belt tightened by the deflection roller.

14. The arrangement according to claim 13, wherein two drive belts form a deflection area, an endless guide belt resting against the deflection roller being mounted in the deflection area.

* * * * *